United States Patent [19]

Marburger et al.

[11] 4,351,522

[45] Sep. 28, 1982

[54] ADJUSTABLE TOY SPRING HORSE

[76] Inventors: Ben Marburger, 810 E. 48th St., Austin, Tex. 78751; Marjorie Mogonye, P.O. Box 415, Elgin, Tex. 78621

[21] Appl. No.: 175,443

[22] Filed: Aug. 4, 1980

[51] Int. Cl.[3] ..... A63G 17/00; A63G 11/00

[52] U.S. Cl. ..... 272/52; 272/55

[58] Field of Search ..... 272/52, 52.5, 53.1, 272/53.2, 55, DIG. 4, 1 C; 297/181; D21/66, 68, 69, 70, 74, 75, 247, 251

[56] References Cited

U.S. PATENT DOCUMENTS

| | | | |
|---|---|---|---|
| 935,854 | 10/1909 | Linerode | 272/55 |
| 1,552,841 | 9/1925 | Hector | 272/30 |
| 1,608,821 | 11/1926 | Sherrod | 272/52 |
| 1,662,875 | 3/1928 | Young et al. | 272/55 |
| 2,050,500 | 8/1936 | Osborn | 272/53.2 |
| 2,770,291 | 11/1956 | Forman | 272/52 |

*Primary Examiner*—Richard J. Apley
*Assistant Examiner*—Arnold W. Kramer

[57] ABSTRACT

The toy spring horse represented by FIG. 1 of our drawing and described in our specifications has four adjustment features. The objects of the described adjustment features are to offer a better control of the toy and to regulate the plaything to the different weights and sizes of the users. The adjustment features are:

The toy spring horse has a longitudinal axis adjustment feature. The body plank 8 is set to the balance bar 3 with bolt 10 through one of the traverse apertures 9 of the body plank 8.

The second adjustment feature of the toy spring horse is a longitudinal adjustment of the combination hand-foot rail section 2 onto the body plank 8. This is accomplished by affixing bolt 22 through one of the channels 5 of the body plank 8.

The third adjustment feature of the toy spring horse sets the foot-rail 14 vertically onto the combination hand-foot rail 2 by setting two bolts 26 through channels 13 of the rail.

The fourth adjustment feature of the toy spring horse is a longitudinal adjustment of the saddle onto the body plank 8 with the placement of four wood screws through the channels 6 in the saddle seat member.

1 Claim, 3 Drawing Figures

ADJUSTABLE TOY SPRING HORSE

The object of our invention is to provide a plaything in the nature of a hobby horse. Our invention is a means of amusement by which the user may enjoy the forward and backward body movements which represent the gallop of a horse.

Another object of our invention is to provide adjustment features which extend the usefulness of the plaything to children of different weights and sizes and which supply safety to the user through better control of the plaything.

Further objectives of the invention are simplicity in construction and inexpense in manufacturing.

A further objective of our invention is to provide children with the effect of a pony ride, with the speed and force of the ride being determined by the exerted effort of the child.

Figure 1:
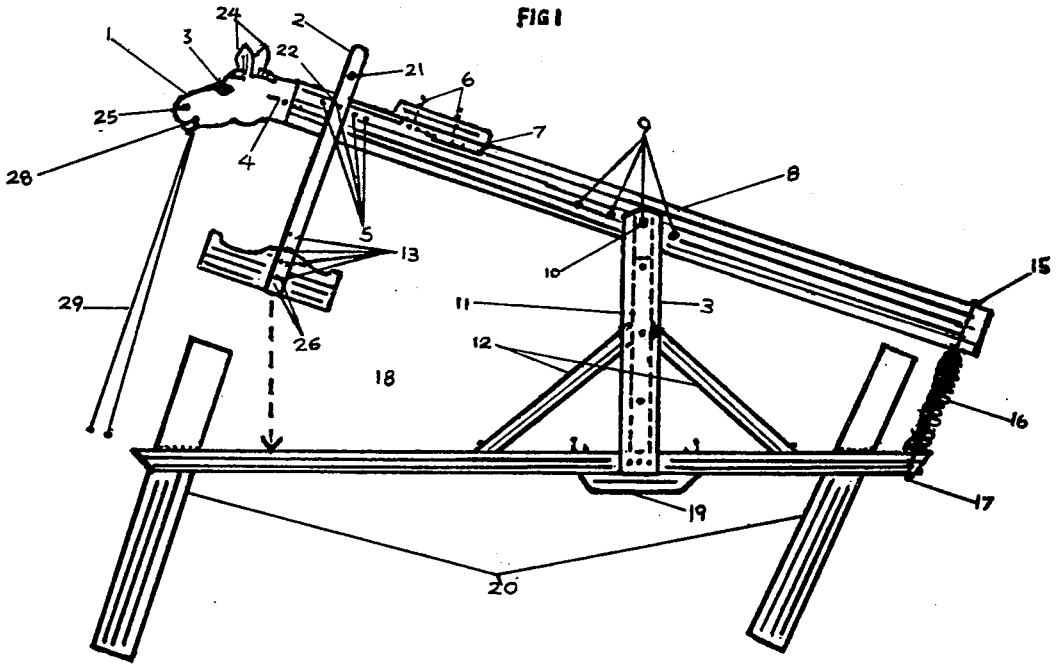

With the foregoing considered, our invention consists of parts and construction characteristics and arrangements more fully described, claimed, and illustrated in the accompanying drawing of:

FIG. 1, a prospect side view of an adjustable toy horse constructed in accordance with our invention.

Figure 2:
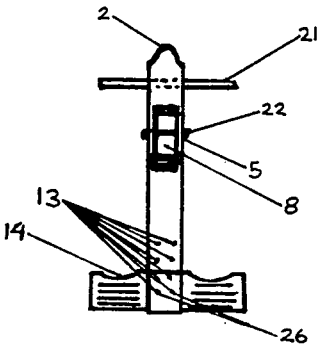

FIG. 2, a fragmentary view of 2 from FIG. 1.

Figure 3:
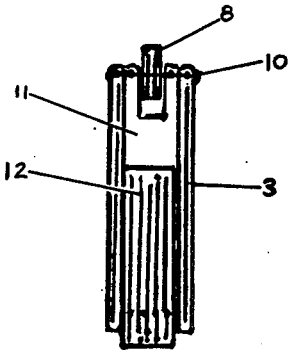

FIG. 3, a vertical view of 3 from FIG. 1.

Referring to numerals to the accompanying drawing which illustrates a material representation of our invention, a base rail 18 is designated which may be formed of wood. The base rail 18 is supported on the underside by crosswise wooden support rails 20, attached proximate to each end and a lengthwise center support 19; each support being shaped to rest on the ground or floor.

Fastened to the upperside of the base rail 18, over the center support 19, is a perpendicular wooden balance bar 3. The core 11, of the balance bar 3, is bifurcated to receive the tilting body plank 8 and formed through the proximate portion of the body plank 8 are traverse apertures 9. Wooden support braces 12 are suitably arranged between the balance bar 3 and base rail 18. This arrangement is best shown in the vertical view of FIG. 3.

An apposite withdrawal bolt or pin 10 passes through the bifurcated end of the balance bar 3 and through one of the traverse apertures 9 on the body plank 8, thus forming an axis or shaft.

The upper end of a retractible spring 16 is secured to the eye of bolt 15 seated on the underside and up through the body plank 8. The bottom end of the spring 16 is connected to the eye bolt 17, seated on the upperside and down through the base rail 18.

A wooden foot rail 14 with bolts 26 fastens to the combination hand-foot rail 2 at one of the vertical adjustment channels 13. The upper portion of the combination hand-foot rail 2 is channeled for passage of the body plank 8 through the hand-foot rail 2. The hand-foot rail 2 collars the body plank 8 on the forward end. A bolt 22 secures the combination hand-foot rail 2 to the body plank 8 at one of the adjustment channels 5. Inserted traversely through the upper end of the hand-foot rail 2 is a wooden rod, hand command 21, the projected ends of which may be grasped and held by the user. Fragmentary view of FIG. 2 best represents this.

A forward projecting wooden member 1, shaped to represent the head and neck of a horse, is attached to the body plank 8 with a dowel rod 4. Members representing the ears 24, plastic fabric laminated to cloth, are attached. The grass rope or halter representation 27 is threaded through a drilled channel. The eyes 23 representation are plastic movable members. The nostrils 25 and mouth 28 are represented by the carving of both forms into the projected member 1.

The member representing the saddle is comprised of three parts; the seat section with adjustment channels 6 and the lower side braces 7. The side braces 7 are attached to the back underside of the saddle section, leaving a center space to accommodate the top of the body plank 8. The saddle member is attached to the body plank 8 by wood screws through the adjustment channels 6.

In the use of the adjustable toy horse, the user may sit on the saddle member at 6 with both feet placed on the foot support 14, hands holding each end of the hand-command 21. The user may move forward causing the front end of the body plank 8 to swing downward from the axis bolt 10 and causing the rear end of the body plank 8 to swing upward from the axis. This creates tension by the extension of the spring 16. The power of the spring 16 draws the rear end of the body plank 8 back down as the user leans backward. The continued forward and backward rocking of the user creates the swinging of the body plank 8 on the axis 10, thus providing enjoyable motion representing the gallop of a horse.

It is understood that minor changes in form, construction, and size of the parts of our adjustable toy horse may be made and substituted for those shown and described herein, without departing from the purpose of which is set forth in the following claim.

We claim as our invention:

1. A hobby horse including a base, a support projecting upwardly from said base, an elongated member pivotally supported by said support about a horizontal axis with respect to the upper portion of said support, spring means biassing the rear end of said elongated member in a downward direction, a seat on said elongated member forward of said pivot axis, a combination hand and foot support mounted on said elongated member forward of said seat, means mounting said elongated member for longitudinal adjustment with respect to said pivot axis, means mounting said seat for adjustment longitudinally on said elongated member, means mounting said combination hand and foot support for longitudinal adjustment of said elongated member, and means mounting said foot support for vertical adjustment relative to the remainder of said combination hand and foot support whereby riders of various sizes and weights can be accomodated.

* * * * *